United States Patent [19]

Rasoulinejad

[11] 3,978,600

[45] Sept. 7, 1976

[54] PHOTO-LIGHT FRAME

[75] Inventor: Seyd M. Rasoulinejad, New York, N.Y.

[73] Assignees: Lawrence Peska Associates, Inc., New York; Thomas Cantone, Valley Stream, both of N.Y. ; part interest to each

[22] Filed: Sept. 8, 1975

[21] Appl. No.: 611,559

[52] U.S. Cl. ..... 40/152.2; 40/131 A; 240/47; 240/108 A

[51] Int. Cl.[2] ..... G09F 13/00

[58] Field of Search ..... 240/10, 47, 108; 40/152.2, 131 R, 131 A, 132 R

[56] References Cited

UNITED STATES PATENTS

| | | | |
|---|---|---|---|
| 1,481,719 | 1/1924 | Lui | 240/108 R X |
| 1,912,118 | 5/1933 | Allen | 40/131 A |
| 2,177,204 | 10/1939 | Buzick et al. | 40/131 R |
| 2,974,435 | 3/1961 | Eschenroeder | 40/131 R |
| 3,056,021 | 9/1962 | Jacobsen | 240/10 R |
| 3,311,743 | 3/1967 | Moore | 240/47 |
| 3,703,045 | 11/1972 | Nyman | 40/152 |

*Primary Examiner*—Louis G. Mancene
*Assistant Examiner*—Wenceslao J. Contreras

[57] ABSTRACT

An illuminated photograph or picture display device is disclosed comprising a first hollow body that is separable into upper and lower segments and which has a lamp assembly mounted therein. The outer surface of the first hollow body has a plurality of face members for mounting pictures and is nestable inside of a second transparent hollow body. Vent holes in the surface of the first hollow body are registerable with vent holes in the second hollow body and allows heat generated by the lamp assembly to be dissipated by convection of heated air within the hollow bodies and the entrance of cooler air into the bodies.

10 Claims, 3 Drawing Figures

FIG. 1
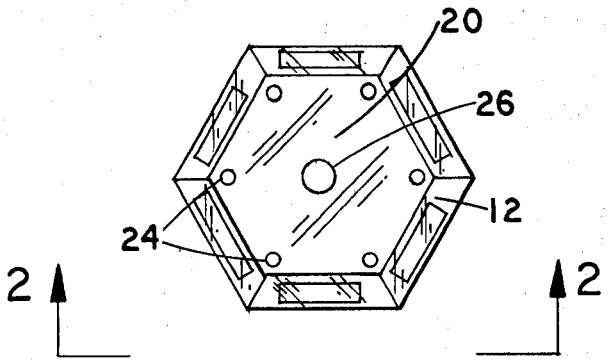
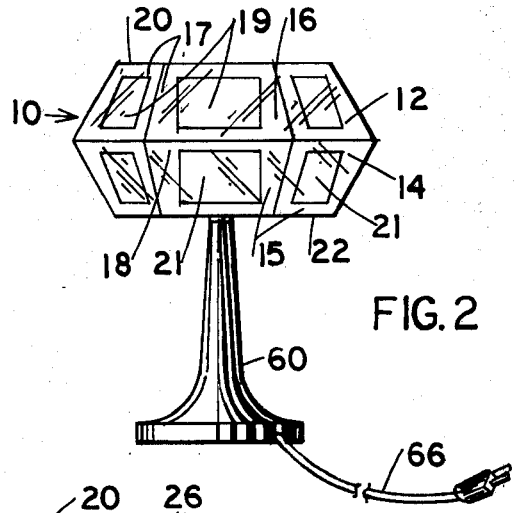
FIG. 2
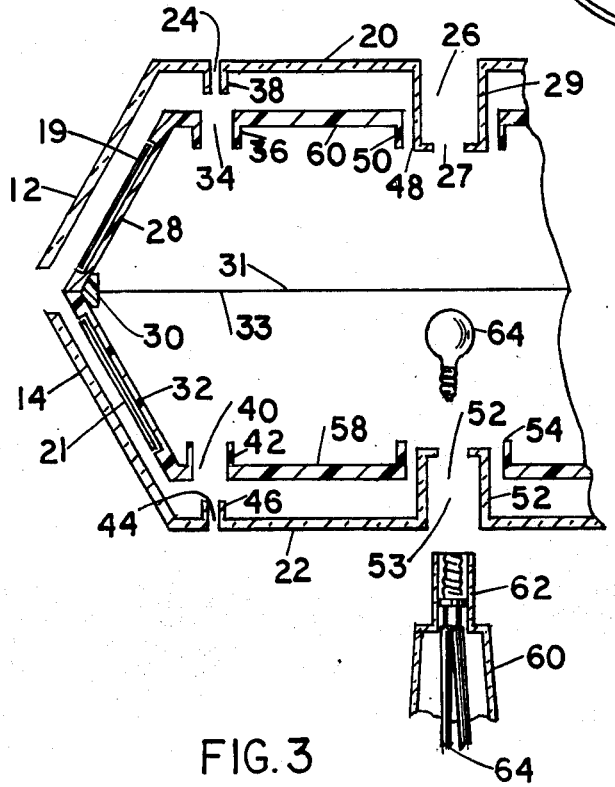
FIG. 3

PHOTO-LIGHT FRAME

SUMMARY OF THE INVENTION

The present invention relates to an illuminated picture display device comprising a first transparent substantially closed hollow body member having a plurality of face members for mounting picture elements thereon, a lamp assembly being positioned within the first hollow body. A second transparent substantially closed hollow body is provided, the inner walls of which being nestable against the outer walls of the first hollow body. Vent holes are provided in the surface of the second body registerable with vent holes in the first hollow body. The first and second hollow bodies may be polyhedrons that are separable into upper and lower segments.

BRIEF DESCRIPTION OF THE SEVERAL VIEWS OF THE DRAWING

FIG. 1 illustrates a plan view of an illuminated picture display device according to one embodiment of the present invention.

FIG. 2 illustrates a side elevation of an illuminated picture display device taken along the line 2—2 of FIG. 1 according to one embodiment of the present invention.

FIG. 3 illustrates a partial side elevation in section of an illuminated picture device according to another embodiment of the present invention.

DETAILED DESCRIPTION

Illuminated picture display devices are known in the art examples of which are illustrated in U.S. Pat. Nos. 3,419,986 Maze; 2,940,198 Ressel and 2,906,048 Kraus. None of these references teaches a device for displaying a plurality of pictures especially in a panaromic way or can be used to view pictures from 360 degrees around the device.

It is therefore an object of the present invention to overcome these and other difficulties encountered in the prior art.

It is a further object of the present invention to provide an illuminated picture display device for displaying a plurality of pictures.

It is also an object of the present invention to provide an illuminated picture display device for displaying a plurality of pictures panoramically.

It is a further object of the present invention to provide an illuminated picture display device for displaying a plurality of pictures that can be viewed from 360 degrees around the device.

These and other objects have been achieved by the present invention and will become apparent by reference to the disclosure and claims that follow as well as the appended drawing.

Referring to the drawing and especially FIGS. 1 through 3 an illuminated picture display device 10 is illustrated comprising a closed hollow body means made up of polyhedron upper segment 12 and polyhedron lower segment 14 having respectively upper plane surface 20 and lower plane surface 22. Segment 12 is joinable to and separable from segment 14 at the edges 16 and 18 thereof these edges being at the periphery of the polyhedron extending about the ends of the horizontal diameter thereof. A plurality of faces 15 and 17 are positioned about the polyhedron through which pictures such as pictures 19 and 21 can be viewed.

The inner walls of polyhedrons 12 and 14 nestably and registerably receive the outer walls of a second hollow body made up of polyhedron segments 28 and 32 separably and joinably secured to one another at edges 31 and 33 thereof, fastening member 30 being provided to secure segments 28 and 32 to one another. Polyhedron segments 28 and 32 have upper plane 50 and lower plane 58 extending from the sides thereof and a plurality of faces corresponding to the faces 15 and 17 projecting inwardly from the periphery extending about the ends of the horizontal diameter of the polyhedron photographs 19 and 21 being secured to their faces. In one embodiment the lower and upper planes 58 and 60 may be made of an opaque material such as a black plastic or a rigid plastic sheet coated with an opacifying material.

Registerable vent holes 24 and 34 as well as 40 and 44 are provided in the upper and lower planes 20, 60, 58 and 22 these vent holes being mounted in the planes where the corners of the faces 15 and 17 meet. Center vent holes 26 and 27 as well as 52 and 53 are also provided, all of the aforementioned vent holes in these upper and lower planes being registerable. Vent holes 24, 34, 40, 44, 26, 27, 52 and 53 all are provided with inwardly projecting collars 38, 36, 42, 46, 29, 50, 54 and 56.

The illuminated picture display device 10 is mounted on a base 60 the upper extremity 62 of which is insertable through openings 52 and 53, the member 62 having a bulb receiving socket therein for screwingly receiving incandescent electric light bulb 64, power cord 64 being operatively connected to member 62 and terminating in electrical cord and plug 66.

In use the illuminated picture display device 10 is assembled from its components by adhering pictures 19 and 21 to the faces of upper and lower polyhedrons 28 and 32 after which polyhedron 32 is nested in polyhedron 14 and the resultant assembly mounted on fixture member 62 through holes 52 and 53. Light bulb 64 is inserted into the socket in member 62 and upper polyhedron 28 is affixed to lower polyhedron 32 through fastening members 30, after which upper polyhedron 12 is nested over upper polyhedron 28. The vent holes allow warm air generated by the lamp assembly to move out of device 10 by convection of heated air within the device and the entrance of cooler air into the device.

The illuminated picture display device 10 of the present invention is made of material such that the pictures 19 and 21 are readily visible through polyhedrons 12 and 14 and may comprise any material known in the art such as glass, a clear plastic material such as the polyacrylic plastics and their co-polymers; polystyrene and its co-polymers and the art-known equivalents thereof.

Although the invention has been described by reference to some embodiments it is not intended that the novel illuminated picture display device or photo-light frame be limited thereby, but that modifications thereof are intended to be included as falling within the broad scope and spirit of the foregoing disclosure, the following claims and the appended drawing.

What is claimed is:

1. An illuminated picture display device comprising a first substantially closed hollow body means having a plurality of face means for mounting picture elements thereon, lamp assembly means positioned within said first hollow body means, second transparent substantially closed hollow body means, the inner wall of said second hollow body nestable against the outer wall of said first hollow body, vent hole means in the surface of said second hollow body registerable with vent hole means in said first hollow body.

2. The illuminated picture display device of claim 1 where said first hollow body comprises a first polyhedron, said second hollow body comprises a second polyhedron, said first polyhedron registerable with said second polyhedron when said first polyhedron is nesting inside of said second polyhedron.

3. The illuminated picture display device of claim 2 where said polyhedrons have a horizontal diameter that divide said polyhedrons in segments, the upper segments and lower segments of said polyhedrons extending in said plurality of face means for mounting pictures, said polyhedrons being separable at the peripheries thereof.

4. The illuminated picture display device of claim 3 where said bottom half of said first polyhedron comprises said face means extending downward to a bottom plane, said upper half of said first polyhedron extending upward to a top plane.

5. The illuminated picture display device of claim 4 where said vent holes are positioned in said bottom plane and said top plane at the corners where said face means are joined and in the center of said top plane and the center of said bottom plane.

6. The illuminated picture display device of claim 5 where said vent holes comprise inwardly projecting collared vent hole means.

7. The illuminated picture display device of claim 6 where said upper half and lower half of said first polyhedron are joinable at said diameter through fastening means.

8. The illuminated picture display device of claim 7 where said vent hole means comprise inwardly projecting collared vent hole means.

9. The illuminated picture display device of claim 8 where said face means projects inwardly from said peripheries of said polyhedrons.

10. The illuminated picture display device of claim 9 where said display is mounted on lamp base means extending through said vent hole means in said bottom plane.

* * * * *